United States Patent [19]

Gundlach

[11] 4,319,692

[45] Mar. 16, 1982

[54] LITTER FREE PROTECTIVE BEVERAGE CAN LID

[76] Inventor: Roy L. Gundlach, 8739 Townhill Dr., St. Louis, Mo. 63126

[21] Appl. No.: 162,084

[22] Filed: Jun. 23, 1980

[51] Int. Cl.[3] ..... B65D 17/32

[52] U.S. Cl. ..... 220/268

[58] Field of Search ..... 220/268, 269; 222/541; 113/121 C

[56] References Cited

U.S. PATENT DOCUMENTS

| | | | |
|---|---|---|---|
| Re. 28,910 | 7/1976 | Dalhi et al. | 113/121 C |
| 2,176,898 | 10/1939 | Fried | 220/268 |
| 3,759,206 | 9/1973 | Dalhi et al. | 113/121 C |
| 3,931,909 | 1/1976 | Dalhi et al. | 220/268 |
| 3,972,445 | 8/1976 | Delenham | 220/268 |
| 4,078,694 | 3/1978 | Gnyp et al. | 220/268 |
| 4,105,134 | 8/1978 | Delenham et al. | 220/268 |
| 4,125,204 | 11/1978 | Klein | 220/268 |
| 4,128,186 | 12/1978 | Gane | 220/268 |
| 4,134,517 | 1/1979 | Rhoades | 220/268 |
| 4,244,490 | 1/1981 | Klein | 220/268 |

*Primary Examiner*—George T. Hall
*Attorney, Agent, or Firm*—Glenn K. Robbins

[57] ABSTRACT

A litter free beverage can lid or top having an inseparable opening tab. The tab has an arcuate shape to provide a cut edge underlying the can top in order that the tab can be pressed downwardly only. A sealant on the bottom of the can top provides a seal until the tab is opened by pressing downwardly. Hinging of the tab extends between the ends of an arcuate cut edge and scoring on the bottom of the lid may be used to facilitate hinging and minimize tearing. A slight inward tapering of the ends of the arcuate cut edge toward the hinge line may also be employed to minimize tearing and facilitate hinging. An enlarged boss on the top of the lid closely surrounds the tab and serves as a protective barrier against accidental contact of the tab by foreign objects such as other cans or the like to avoid accidental contact against the tab and premature opening. Another boss is formed on the top of the tab congruent with and adjacent the arcuate edge to provide a positioning stop and fulcrum for the thumb of the user in the opening operation.

14 Claims, 11 Drawing Figures

LITTER FREE PROTECTIVE BEVERAGE CAN LID

BACKGROUND OF THE INVENTION

In the past various types of beverage can tops or lids have been employed with a multitude of different types of opening tabs. Many of such tabs have been disengageable and provide a litter problem. Other tabs have been devised which while not being disengageable are pushed downwardly and may be broken or torn or discharged into the contents of the can to present a health hazard to the user.

A further problem has been to provide a tab which can not be prematurely or accidentally opened by contact with a foreign object such as another can as in an ice chest or the like where movement and shifting is involved.

Still another problem in the industry has been the difficulty presented in the opening of the tab. Tearing of the tab caused by uneven pressure of the user's thumb or even cuts caused by the edges of the tab opening have been encountered and have presented a problem which has been desirable to avoid.

SUMMARY OF THE INVENTION

By means of the instant invention there has been provided a litter free tab for a beverage can lid or top which is virtually accident free and can not be torn off in the opening operation and discarded to present a litter problem. The can lid is easily opened through a guide or positioning boss and presents a large arcuate area to the user for proper discharge of the contents to the mouth when the contents are consumed directly from the can or poured.

The can is further provided with a protective boss means surrounding the tab to prevent accidental opening by a foreign object particularly the edge of another can or the like.

The tab provided on the can lid or top of this invention is formed by an arcuate lancing or punching of the tab from the top of the lid. This operation slightly draws or expands the arcuate cut edge of the tab and causes it to underly and slightly overlap the lid so that the tab can not be pushed upwardly and can only be opened by pushing downwardly. A conventional plastic sealant is employed on the underside of the lid to seal hermetically the arcuate cut edge of the tab to the underside of the lid.

Hinging is effected through the natural flexibility of the thin gauge sheet metal used in the fabrication of the lid for the conventional metallic structure of sheet aluminum or steel. The hinging may be facilitated by an underscoring or scarfing between the ends of the arcuate edge of the tab. A further facilitation of the hinging operation and avoidance of tearing is effected by a slight inward tapering or turning of the ends of the arcuate cut to the hinge line.

To facilitate opening of the tab and to provide a fulcrum or pressure point for the thumb of the user in the tab opening operation a thumb boss is provided on the tab. This tab is of an arcuate configuration generally congruent to the arcuate edge of the tab and closely positioned thereto.

Protection against contact by a foreign object such as the end of another can is provided by an enlarged boss closely surrounding the tab arcuate edge and hinge line. This boss may extent upwardly to a substantially flush position with the conventional rim of the can to present a protective barrier that protects the tab against contact by the rounded end of a can that might otherwise hit the tab and cause its premature opening.

Through the tab construction of this invention there has been provided a litter free device which can be simply constructed and easily employed by the ultimate user at an inexpensive cost avoiding extensive scoring and the requirement of constantly sharpening the scoring tools. The lid is to a high degree puncture proof in the sense that the tab can not be easily opened by contact with another can. Further through the guide boss the user can with great facility find and bring to bear the light amount of pressure needed to open the tab and avoid any danger from cutting himself on the edges of the tab and the opening.

The above features are object of this invention. Further objects of this invention will appear in the detailed description which follows and will be otherwise apparent to those skilled in the art.

For the purpose of description of this invention preferred embodiments are shown in the accompanying drawings.

It is to be understood that these drawings are for the purpose of example only.

IN THE DRAWINGS

DESCRIPTION OF THE INVENTION

Figure 2:
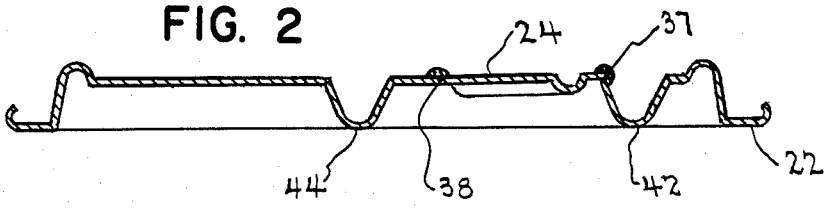
FIG. 2, is a sectional view taken on the line 2—2 of FIG. 1.
Figure 1:
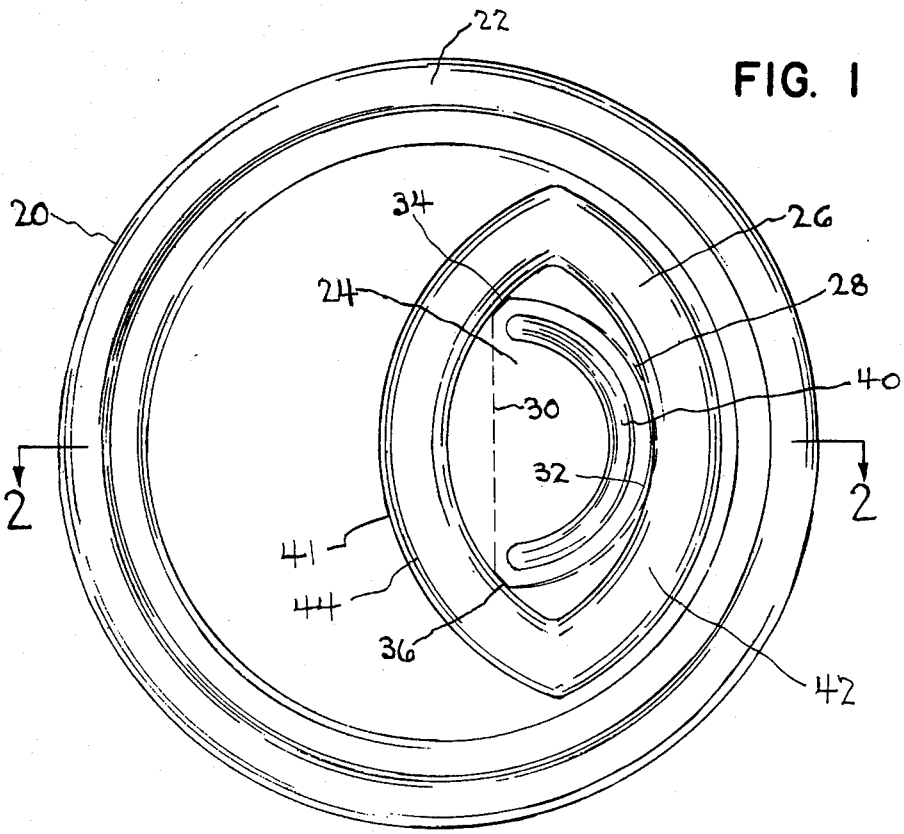
FIG. 1, is an enlarged top plan view of one embodiment of the beverage can lid of this invention.
Figure 3:
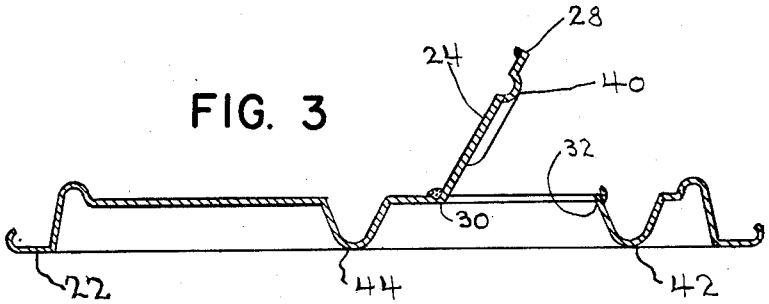
FIG. 3, is a view similarly to FIG. 2, but showing the tab opened.

The beverage can lid of this invention is generally identified by the reference numeral 20 in FIGS. 1 through 4. It is formed as a top end of a conventional sheet metal can (not shown) constructed of aluminum, steel or tin plate or other conventional thin gauge metallic material as is well-known in the art.

The lid is comprised of a rim 22 which fits over and is adapted to be connected to the side walls of a can, a tab 24 and a protective embossed guard 26.

The tab 24 is formed of a semi-circular arcuate edge 28 and a hinge portion 30 extending between the arcuate edge 28. The arcuate edge is formed by a lancing or punching operation which cuts through the metal of the lid. In this operation as the lancing or punching tool pushes the tab downward there is a slight drawing effect which expands the edge portion of the tab and causes it to overlap and underlie the can lid as shown in the dotted line of FIG. 1. The arcuate edge of the can opening is shown by the full line 32.

In order to facilitate the hinging of the tab when opened by the user the cut edge of the tab is provided with tapering portion 34 and 36 which extend to about 45° to the hinge line 32. This effectively prevents any tendency to tear along the line when the tab is opened.

In order to provide a seal 37 for the arcuate edge of the tab underlying the tab opening in the lid an approximate sealant or adhesive is employed. Such sealants are conventional and form no part of this invention, per se. Such sealants may be a conventional General Electric RTV white silicone adhesive approved by the FDA or other adhesive sealants comprised of polyvinyl chloride, polyvinyl dichloride, polyethylene and polyamides and the like.

The tab with the sealant provides an effective hermetic seal for the conventional pressurized contents when the can is filled. The tab, since it underlies the lid is larger than the tab opening and can not be opened outwardly.

The hinge line 32 extends between the ends of the arcuate edge of the tab and may be effected through the natural flexibility of the thin gauge sheet metal employed in the construction of the lid. Conventionally the thickness of the lid may be in the order of 0.011 to 0.014 of an inch. It has however been found desirable to create a line of weakness in the hinge to facilitate the opening of the tab by underscoring the hinge line 32 for example to provide a thickness to about 0.005 of an inch. This underscoring or scarfing is indicated by the reference numeral 38 in FIG. 2.

A thumb stop 40 is provided in order to provide a rest or guide for the user's thumb in the tab opening operation. The stop is in the form of a raised arcuate embossing which is generally congruent with the arcuate edge of the tab and is located closely adjacent thereto. This stop not only serves as a rest or guide but also provides a fulcrum base for the exertion of pressure by the thumb in the opening of the tab. In addition, the stop serves as a barrier to inhibit the contact of the thumb with the edge of the tab opening 32 to avoid possible cuts to the thumb.

An enlarged boss 41 serves as a protective barrier against accidental contact of the tab by the rounded end of another can. This boss is comprised of an arcuate boss 42 coradial with the can rim and an opposed arcuate boss 44 which surrounds and protects the tab. The bosses are of a height approaching the elevation of the rim above the lid in order to provide a miximum of protection to the tab and yet not interfere with stacking.

A modified lid construction is generally indicated by the reference numeral 50 in FIGS. 5 through 8. In this construction elements having the same construction as the lid 20 in the embodiment of FIGS. 1 through 4 will be given the same reference numerals. In this embodiment the tab 52 is of the same construction as that previously described but the hinge line 54 rather than being closer to the center is located adjacent the can rim. The other construction is the same.

The reversal of the hinge line in the lid 50 as compared to the lid 20 presents the discharge of contents along a flat mouth or weir. The arcuate top edge of the tab opening extends closer to the center of the can and present a somewhat different flow discharge to the user which may be preferred by some users.

Figure 2A:
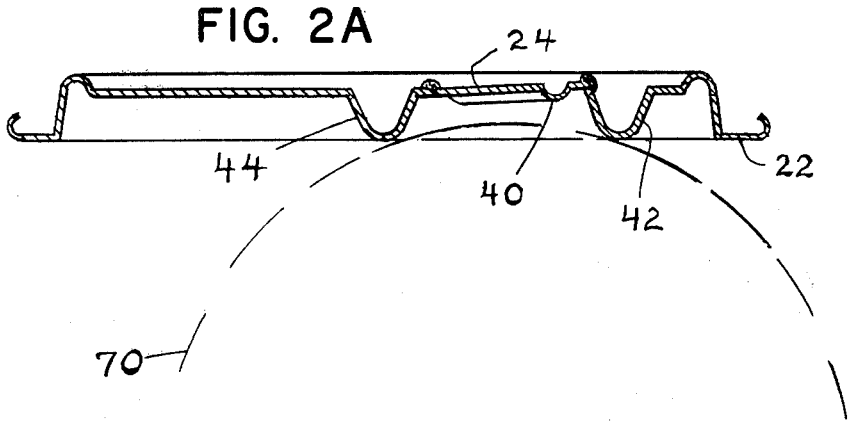
FIG. 2A, is a view in section taken similarly to FIG. 2, showing the blocking of a can on the short side of the protective boss.
Figure 8A:
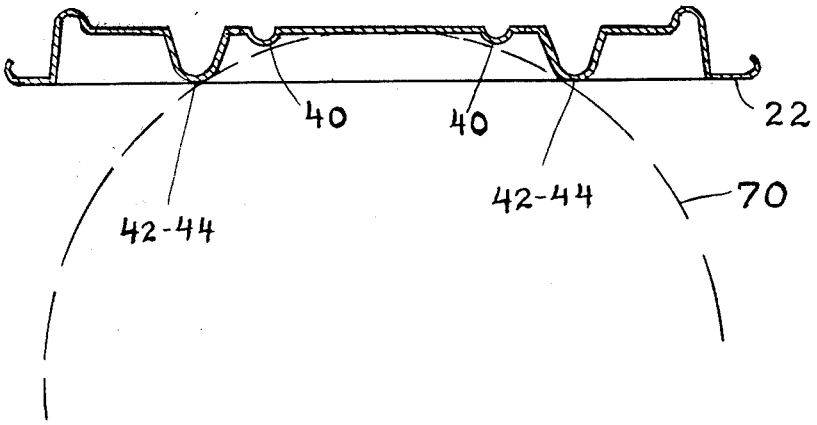
FIG. 8A, is an enlarged view in section taken on line 8A—8A of FIG. 8 showing the blocking of a can on the long side of the protective boss.
Figure 4:
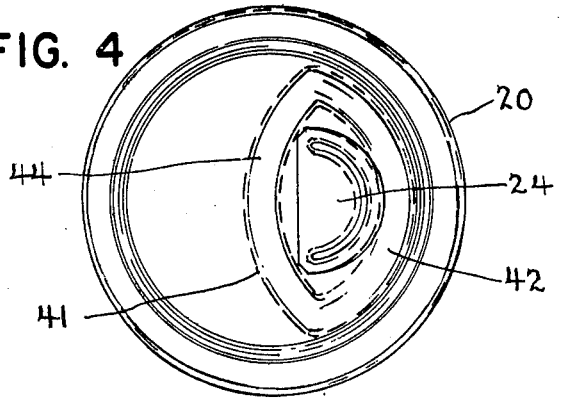
FIG. 4, is a bottom plan view of the lid on approximately actual scale.
Figure 12:
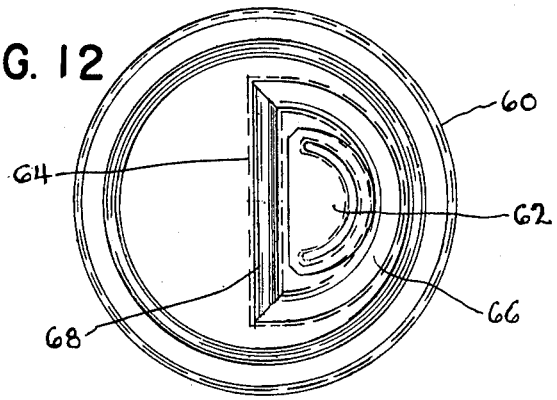
FIG. 12, is a bottom plan view of the further modified lid on approximately actual scale.
Figure 8:
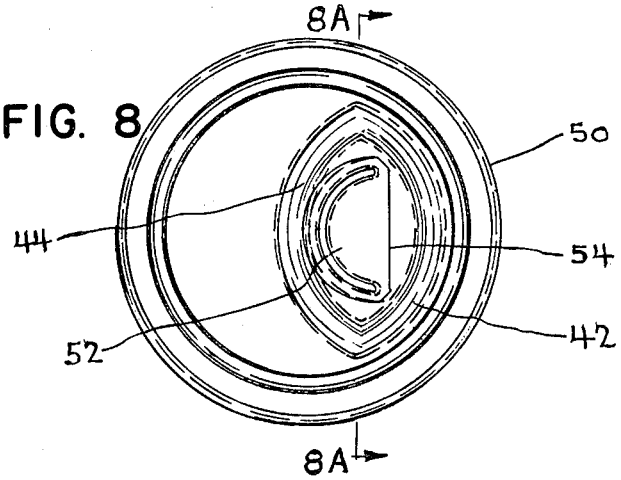
FIG. 8, is a bottom plan view of the modified lid on approximately actual scale.
Figure 6:
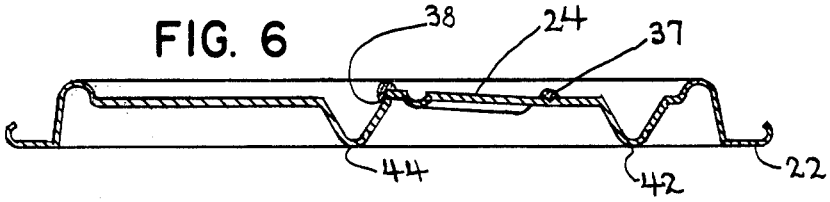
FIG. 6, is a view in section taken on the line 6—6 of FIG. 5.
Figure 5:
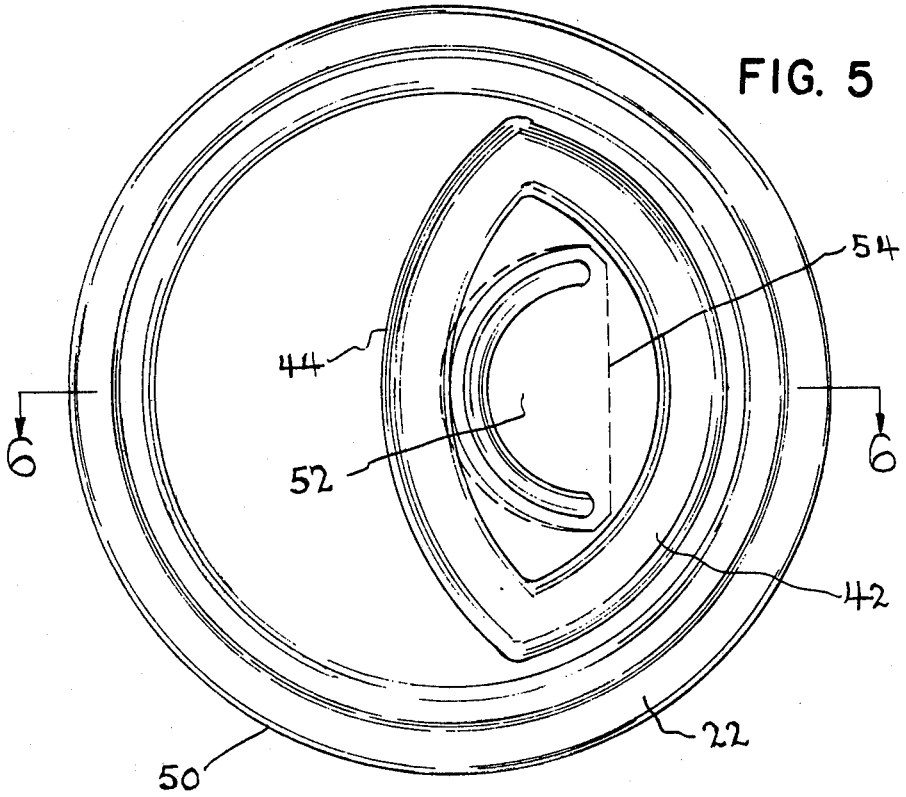
FIG. 5, is an enlarged top plan view of a modification of the lid.
Figure 7:
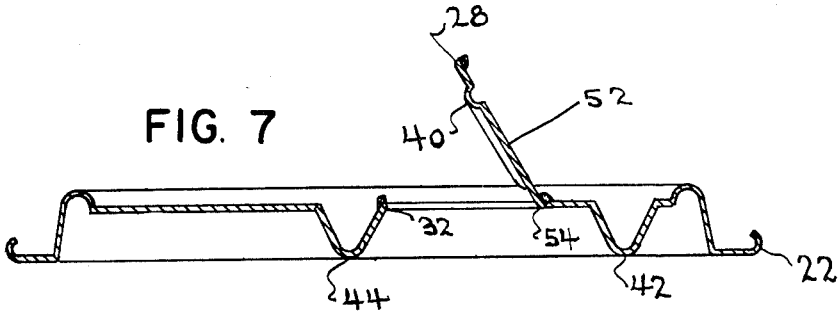
FIG. 7, is a view similar to FIG. 6, but showing the tab opened.
Figure 10:
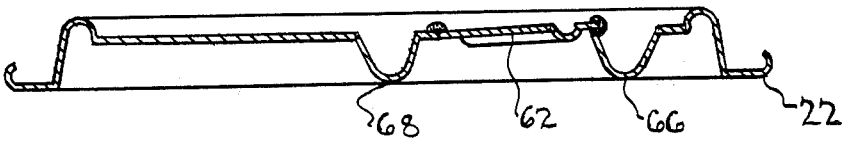
FIG. 10, is a sectional view taken on the line 10—10 of FIG. 9.
Figure 9:
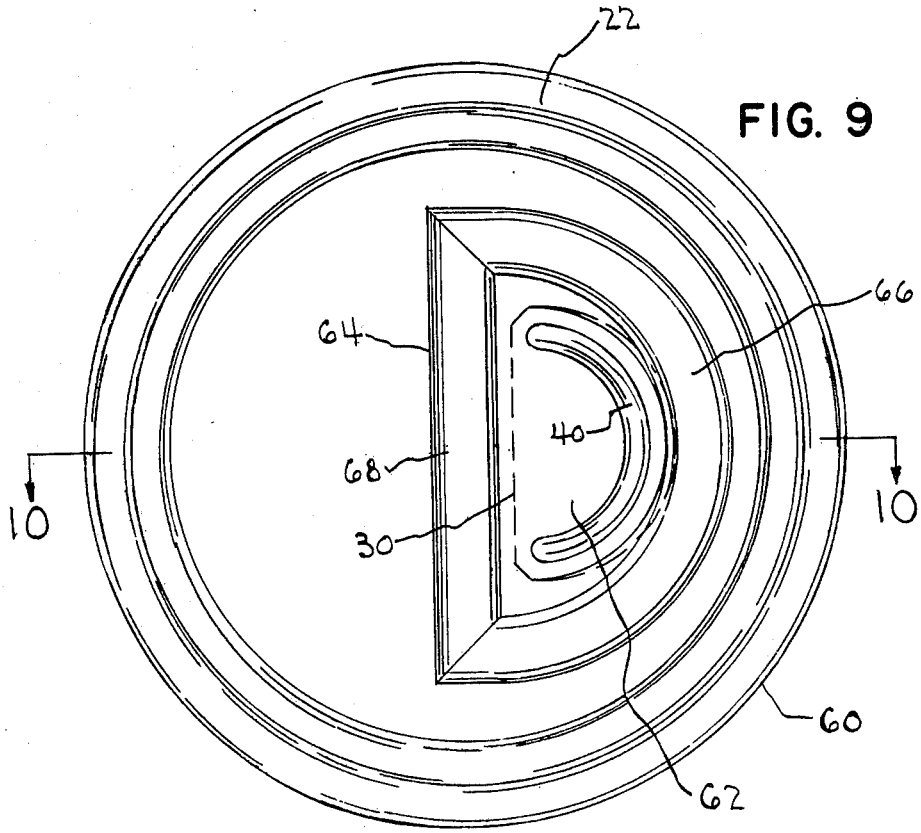
FIG. 9, is an enlarged top plan view of a further modification of the lid.
Figure 11:
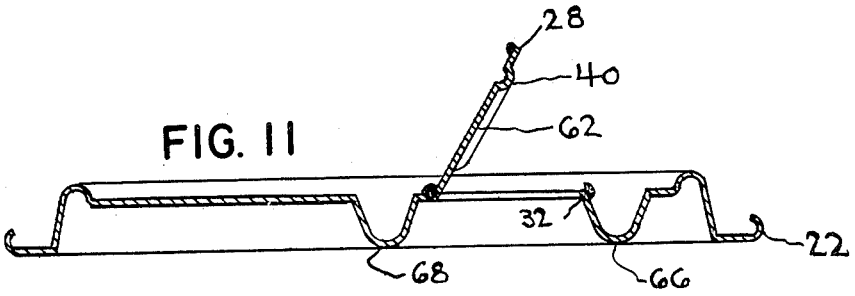
FIG. 11, is a view similar to FIG. 10, but showing the tab opened.

The blocking of another can from effective contact with the tab is shown in FIGS. 2A and 8A. In FIG. 2A another can shown in dotted lines and identified by reference numeral 70 is presented at its rounded end across the bosses 42 and 44 which presents the short side of axis across the barrier. In this position the can is blocked out of contact with the tab.

In FIG. 8A the can 70 is shown presented across the long side of the protective barrier at the opposite junction of the protective bosses 42 and 44 representing the long side or axis of the protective barrier or boss. This latter position presents the optimum possibility for contact of the can with the tab and it can be seen that the can is out of contact with the thumb stop boss 40 and has only a tangential contact with the tab base where only negligible pressure can be exerted due to the blocking effect of the boss and the flexibility provided by the ridged boss and tab construction. If such tangential contact is desired to be avoided the protective boss junctions at this position may be simply moved slightly closer together.

A further modified lid construction is generally indicated by the reference numeral 60 in FIGS. 9 through 12. Like elements of construction to those described for the lid 20 will be given the same reference numerals. In this construction the tab 62 is of the same construction as the tab 24 and has the same hinge line. The protective boss 64 however is comprised of a semi-circular boss 66 merging with a straight boss 68. This provides a congruent framing protective barrier for the tab and further strengthens the tab construction through the congruency relationship.

USE

The beverage can lid 20 is used in a simple and obvious fashion. Thus the user simply places his thumb on the tab 24 with the edge of the thumb resting against the stop 40. The user than presses down with sufficient force to break the adhesive seal 37 to present the opening formed by the arcuate edge of the lid 32. All of the lid embodiments 20, 50 and 60 are used in an identical manner.

In each of the embodiments the thumb stop 40 provides a guide and rest for the user's thumb in automatic positioning. The stop further serves as a fulcrum for the thumb in the exertion of pressure and also aids in minimizing contact with the lid edge 32. This edge is slightly turned downward in the lancing or punching operation and this feature in combination with the function of the thumb stop provides for a safe opening operation of the tab.

In use the protective boss in all the modifications 20, 50 and 60 serves to prevent contact of the tab by another can in random movement than might occur in packing, stacking, use in ice chests and the like.

Various changes and modifications may be made in this invention as will readily appear to those skilled in the art. Such changes and modifications are within the scope and teaching of this invention as defined by the claims appended hereto.

What is claimed is:

1. A litter free beverage can lid comprising a circular metallic substantially flat base connected to an upstanding circular rim surrounding said base, said base being provided with a tab substantially coplanar with said base and having a free substantially semi-circular arcuate edge underlying a substantially semi-circular arcuate edge on said base defining a substantially semi-circular arcuate tab opening when said tab is pushed downward to present said opening for discharge of contents, sealing means on said underlying tab arcuate edge on the underside of said base, hinge means extending between the arcuate edge of said tab and a protective boss extending completely around said tab positioned inwardly of said rim and extending above said flat base and above said tab to a height not exceeding the height of said circular rim and closely surrounding said tab to protect said tab from accidental contact by other beverage cans.

2. The lid of claim 1, in which said boss extends above said base to approximately the same height of said upstanding circular rim on said lid.

3. The lid of claim 2, in which said boss is formed of a convex ridge extending above said base.

4. The lid of claim 1, in which said arcuate free edge of the tab has a pair of free ends having extensions tapering inwardly to said hinge means to minimize any tearing tendency.

5. The lid of claim 1, in which said hinge means is comprised of an underscoring on the underside of said base, said underscoring extending between the ends of said aforementioned arcuate edge of the tab.

6. The lid of claim 1, in which a thumb stop is provided on the top of said tab, said stop being comprised of an arcuate boss closely positioned to said arcuate edge of the tab.

7. The lid of claim 6, in which said boss is generally congruent to said arcuate edge and is elevated above said tab a sufficient degree to provide a rest and fulcrum for the thumb for the presentation of a downward force sufficient to break said sealing means in the tab opening operation.

8. The lid of claim 2, in which a thumb stop is provided on the top of said tab, said stop being comprised of an arcuate boss closely positioned to said arcuate edge of the tab and said thumb stop is of a lesser height than said protective boss.

9. The lid of claim 1, in which said hinge means is located adjacent the center of the lid and said arcuate edge of the tab is located toward the circular rim of said lid.

10. The lid of claim 1, in which said hinge means is located adjacent a circular rim of the lid and said arcuate edge is located adjacent the center of the lid.

11. The lid of claim 1, in which said protective boss is comprised of a pair of convex arc segments connected together and closely surrounding said tab.

12. The lid of claim 1, in which said protective boss is comprised of a straight segment and a convex arc segment connected together and closely surrounding said tab.

13. The lid of claim 9, in which said protective boss is comprised of a straight segment and a convex arc segment connected together and closely surrounding said tab, said straight segment being located adjacent the center of the lid and said convex arc segment being located between the arcuate edge of the tab and said circular rim.

14. The lid of claim 4, in which said hinge means is comprised of an underscoring on the underside of said base, said underscoring extending between the ends of said aforementioned arcuate edge of the tab and a thumb stop is provided on the top of said tab, said stop being comprised of an arcuate boss closely positioned to said arcuate edge of the tab.

* * * * *